US011486577B1

(12) United States Patent
Neal

(10) Patent No.: US 11,486,577 B1
(45) Date of Patent: Nov. 1, 2022

(54) COOKING APPLIANCE WITH ELECTRONICALLY-CONTROLLED GAS BURNER VERIFICATION

(71) Applicant: Midea Group Co., Ltd., Foshan (CN)

(72) Inventor: Vern A. Neal, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 49 days.

(21) Appl. No.: 17/331,925

(22) Filed: May 27, 2021

(51) Int. Cl.
*F23N 5/24* (2006.01)
*F24C 3/10* (2006.01)
*F24C 3/12* (2006.01)

(52) U.S. Cl.
CPC ..... *F23N 5/242* (2013.01); *F24C 3/103* (2013.01); *F24C 3/128* (2013.01); *F23N 2223/08* (2020.01); *F23N 2227/16* (2020.01); *F23N 2229/00* (2020.01); *F23N 2231/12* (2020.01); *F23N 2235/18* (2020.01); *F23N 2241/08* (2020.01)

(58) Field of Classification Search
CPC ..... F24C 3/128; F24C 3/103; F23N 5/242
USPC ..... 126/39 E, 39 R; 431/24
See application file for complete search history.

(56) References Cited

U.S. PATENT DOCUMENTS 3,026,932 A 3/1962 Algino
4,518,345 A 5/1985 Mueller et al.
5,589,627 A * 12/1996 Sutton ..... F23N 5/242 73/1.06
6,082,991 A * 7/2000 Rozenberg ..... B29C 49/064 264/537
6,103,410 A * 8/2000 Fuller ..... H01M 8/2457 429/444
6,164,958 A * 12/2000 Huang ..... F23N 5/242 431/77
8,882,492 B2 * 11/2014 Querejeta Andueza ..... F24C 3/103 431/46
2009/0092937 A1 4/2009 Crnkovich et al.
2011/0086319 A1 4/2011 Chodacki et al.
2019/0107287 A1 4/2019 Kitabayashi et al.
2020/0096200 A1 * 3/2020 Leeseberg ..... F24C 3/126
2022/0026066 A1 * 1/2022 Abe ..... F23N 5/203
2022/0042682 A1 * 2/2022 Suzuki ..... F23N 5/242
2022/0260258 A1 * 8/2022 Cowan ..... F24C 3/124

FOREIGN PATENT DOCUMENTS

EP 2578947 A1 4/2013
EP 2500651 A3 4/2015
WO WO2016079584 A2 5/2016

* cited by examiner

*Primary Examiner* — Vivek K Shirsat
(74) *Attorney, Agent, or Firm* — Middleton Reutlinger

(57) ABSTRACT

An apparatus, cooking appliance and method functionally verify a gas burner that is controlled by two or more electronically-controlled gas valves coupled in series with one another. Functional verification is performed during ignition and/or shut off of the gas burner at least in part by sequencing the activation and/or deactivation of the gas valves and testing the ignition state of the gas burner while one of the valves is activated and the other is deactivated.

22 Claims, 6 Drawing Sheets

COOKING APPLIANCE WITH ELECTRONICALLY-CONTROLLED GAS BURNER VERIFICATION

BACKGROUND

Cooking appliances such as cooktops, ovens and ranges may be powered by various types of burners or cooking elements, with electrical heating elements and gas burners being among the most common. In particular, gas burners generally use as an energy source a combustible gas such as natural gas or liquified petroleum (LP) gas (also referred to as propane), and generate heat by combusting and burning the gas. The output levels of gas burners are generally controlled by valves, which regulate gas flow to the gas burners, and which are coupled either mechanically or electronically to associated user controls, e.g., knobs, sliders, or the like. Gas burners also generally require some manner of igniting the burners. For gas cooktop burners, for example, spark igniters are commonly used, while for gas oven burners, hot surface igniters are also commonly used. In addition, some cooking appliances incorporate automatic ignition modules that include flame sensors and that are capable of automatically re-igniting a gas burner in response to a detected flame loss by a flame sensor.

Electronically-controlled gas burners present a number of failure mechanisms that, if not properly diagnosed, could result in either an inability to ignite a gas burner, an inability to shut off a gas burner, or potentially an output of uncombusted gas from the gas burner. An electromechanical gas valve, for example, could stick in an open or closed position, or an igniter could fail to operate. In addition, miswirings could occur during manufacture or during service.

Therefore, a need continues to exist in the art for a manner of verifying the proper operation of an electronically-controlled gas burner.

SUMMARY

The herein-described embodiments address these and other problems associated with the art by providing an apparatus, cooking appliance and method that functionally verify a gas burner that is controlled by two or more electronically-controlled gas valves coupled in series with one another. Functional verification is performed during ignition and/or shut off of the gas burner at least in part by sequencing the activation and/or deactivation of the gas valves and testing the ignition state of the gas burner while one of the valves is activated and the other is deactivated.

Therefore, consistent with one aspect of the invention, a cooking appliance may include a gas burner configured to generate heat for cooking, an ignition sensor positioned proximate to the gas burner and configured to detect ignition of the gas burner, first and second gas valves coupled in series to the gas burner to supply gas from a gas supply to the gas burner, where each of the first and second gas valves is electronically-controllable, and a controller coupled to the ignition sensor and the first and second gas valves. The controller is configured to functionally verify the gas burner over one or more cooking operations by during ignition of the gas burner, activating the first gas valve prior to activating the second gas valve and confirming with the ignition sensor that the gas burner is not ignited while the first gas valve is activated and the second gas valve is deactivated, after confirming with the ignition sensor that the gas burner is not ignited while the first gas valve is activated and the second gas valve is deactivated, activating the second gas valve and confirming with the ignition sensor that the gas burner is ignited while the first and second gas valves are activated, and during shut off of the gas burner, deactivating the first gas valve prior to deactivating the second gas valve and confirming with the ignition sensor that the gas burner is not ignited while the first gas valve is deactivated and the second gas valve is activated.

In some embodiments, the controller is further configured to detect a valve close error for the second gas valve in response to detecting that the gas burner is ignited while the first gas valve is activated and the second gas valve is deactivated during ignition of the gas burner. Also, in some embodiments, the controller is further configured to detect a valve close error for the first gas valve in response to detecting that the gas burner is ignited while the first gas valve is deactivated and the second gas valve is activated during shut off of the gas burner. Further, in some embodiments, the controller is further configured to detect an ignition error in response to failing to detect that the gas burner is ignited while the first and second gas valves are activated during ignition of the gas burner.

In some embodiments, the controller is further configured to generate an error notification for the gas burner in response to detecting at least one of the gas burner is ignited while the first gas valve is activated and the second gas valve is deactivated during ignition of the gas burner, the gas burner is ignited while the first gas valve is deactivated and the second gas valve is activated during shut off of the gas burner, and the gas burner is ignited while the first and second gas valves are activated during ignition of the gas burner. In addition, in some embodiments, the controller is further configured to deactivate each of the first and second gas valves in response to detecting at least one of the gas burner is ignited while the first gas valve is activated and the second gas valve is deactivated during ignition of the gas burner, the gas burner is ignited while the first gas valve is deactivated and the second gas valve is activated during shut off of the gas burner, and the gas burner is ignited while the first and second gas valves are activated during ignition of the gas burner.

In some embodiments, the ignition sensor is a flame detector. Some embodiments may also include an igniter positioned proximate to the gas burner and configured to ignite gas supplied to the gas burner, where the control is configured to activate the igniter during ignition of the gas burner. In some embodiments, the controller is configured to wait a first predetermined time between activating the first gas valve and confirming with the ignition sensor that the gas burner is not ignited while the first gas valve is activated and the second gas valve is deactivated, wait a second predetermined time between activating the second gas valve and confirming with the ignition sensor that the gas burner is ignited while the first and second gas valves are activated, and wait a third predetermined time between deactivating the first gas valve and confirming with the ignition sensor that the gas burner is not ignited while the first gas valve is deactivated and the second gas valve is activated.

In addition, some embodiments may also include an oven cavity, and the gas burner is an oven gas burner configured to generate heat within the oven cavity. In addition, some embodiments may further include a cooktop, and the gas burner is a cooktop gas burner. In some embodiments, each of the first and second gas valves are dedicated to the gas burner. Moreover, in some embodiments, the gas burner is a first gas burner and the ignition sensor is a first ignition sensor, and the cooking appliance further includes a second gas burner configured to generate heat for cooking, a second ignition sensor positioned proximate to the second gas burner and configured to detect ignition of the second gas burner, and a third gas valve coupled in series with one of the first and second gas valves to supply gas from the gas supply to the second gas burner, where the one of the first and second gas valves is shared by the first and second gas burners. In some embodiments, the first gas valve is upstream of the second gas valve, and in some embodiments, the first gas valve is downstream of the second gas valve.

In some embodiments, the controller is configured to deactivate the first gas valve prior to deactivating the second gas valve and confirm with the ignition sensor that the gas burner is not ignited while the first gas valve is deactivated and the second gas valve is activated during a first shut off of the gas burner, and the controller is further configured to, during a second shut off of the gas burner, deactivate the second gas valve prior to deactivating the first gas valve and confirm with the ignition sensor that the gas burner is not ignited while the first gas valve is activated and the second gas valve is deactivated. Moreover, in some embodiments, at least one of ignition of the gas burner and shut off of the gas burner is performed in response to user input associated with the one or more cooking operations.

Consistent with another aspect of the invention, a cooking appliance may include a gas burner configured to generate heat for cooking, an ignition sensor positioned proximate to the gas burner and configured to detect ignition of the gas burner, first and second gas valves coupled in series to the gas burner to supply gas from a gas supply to the gas burner, where each of the first and second gas valves is electronically-controllable, and a controller coupled to the ignition sensor and the first and second gas valves. The controller is configured to functionally verify the gas burner over one or more cooking operations by during a first shut off of the gas burner performed when the first and second gas valves are activated and the gas burner is ignited, deactivating the first gas valve prior to deactivating the second gas valve and confirming with the ignition sensor that the gas burner is not ignited while the first gas valve is deactivated and the second gas valve is activated, and during a second shut off of the gas burner performed when the first and second gas valves are activated and the gas burner is ignited, deactivating the second gas valve prior to deactivating the first gas valve and confirming with the ignition sensor that the gas burner is not ignited while the first gas valve is activated and the second gas valve is deactivated.

Also, in some embodiments, the controller is further configured to generate an error notification for the gas burner in response to detecting at least one of the gas burner is ignited while the first gas valve is deactivated and the second gas valve is activated during the first shut off of the gas burner, and the gas burner is ignited while the first gas valve is activated and the second gas valve is deactivated during the second shut off of the gas burner. In some embodiments, the controller is further configured to deactivate each of the first and second gas valves in response to detecting at least one of the gas burner is ignited while the first gas valve is deactivated and the second gas valve is activated during the first shut off of the gas burner, and the gas burner is ignited while the first gas valve is activated and the second gas valve is deactivated during the second shut off of the gas burner.

Consistent with another aspect of the invention, an apparatus may include a gas burner configured to generate heat, an ignition sensor positioned proximate to the gas burner and configured to detect ignition of the gas burner, first and second gas valves coupled in series to the gas burner to supply gas from a gas supply to the gas burner, where each of the first and second gas valves is electronically-controllable, and a controller coupled to the ignition sensor and the first and second gas valves. The controller is configured to functionally verify the gas burner by during ignition of the gas burner, activating the first gas valve prior to activating the second gas valve and confirming with the ignition sensor that the gas burner is not ignited while the first gas valve is activated and the second gas valve is deactivated, after confirming with the ignition sensor that the gas burner is not ignited while the first gas valve is activated and the second gas valve is deactivated, activating the second gas valve and confirming with the ignition sensor that the gas burner is ignited while the first and second gas valves are activated, and during shut off of the gas burner, deactivating the first gas valve prior to deactivating the second gas valve and confirming with the ignition sensor that the gas burner is not ignited while the first gas valve is deactivated and the second gas valve is activated.

Consistent with another aspect of the invention, an apparatus may include a gas burner configured to generate heat, an ignition sensor positioned proximate to the gas burner and configured to detect ignition of the gas burner, first and second gas valves coupled in series to the gas burner to supply gas from a gas supply to the gas burner, where each of the first and second gas valves is electronically-controllable, and a controller coupled to the ignition sensor and the first and second gas valves, the controller configured to functionally verify the gas burner by during a first shut off of the gas burner performed when the first and second gas valves are activated and the gas burner is ignited, deactivating the first gas valve prior to deactivating the second gas valve and confirming with the ignition sensor that the gas burner is not ignited while the first gas valve is deactivated and the second gas valve is activated, and during a second shut off of the gas burner performed when the first and second gas valves are activated and the gas burner is ignited, deactivating the second gas valve prior to deactivating the first gas valve and confirming with the ignition sensor that the gas burner is not ignited while the first gas valve is activated and the second gas valve is deactivated.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
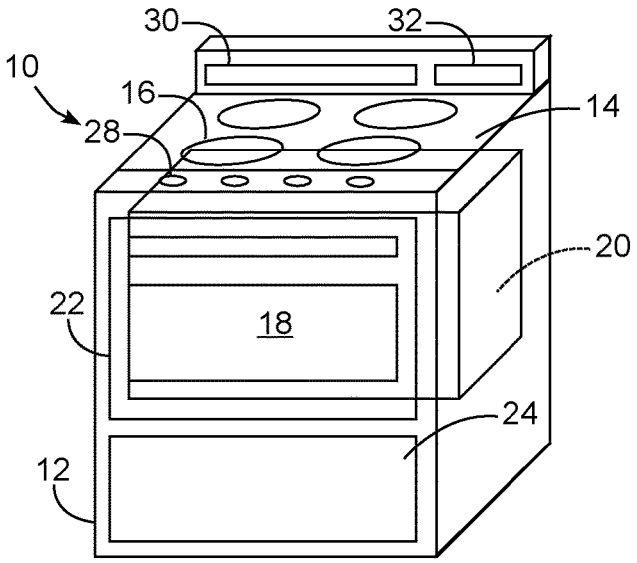
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas cooking elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave cooking elements in some embodiments, while in the case of a stovetop, one or more cooking elements therein may be gas, electric, or inductive cooking elements in some embodiments. Further, it will be appreciated that any number of cooking elements may be provided in a cooking appliance (including multiple cooking elements for performing different types of cooking cycles such as baking or broiling, including multiple bake and/or multiple broiler cooking elements, as well as one or more convection cooking elements), and that multiple types of cooking elements may be combined in some embodiments, e.g., combinations of microwave and light cooking elements in some oven embodiments.

Figure 2:
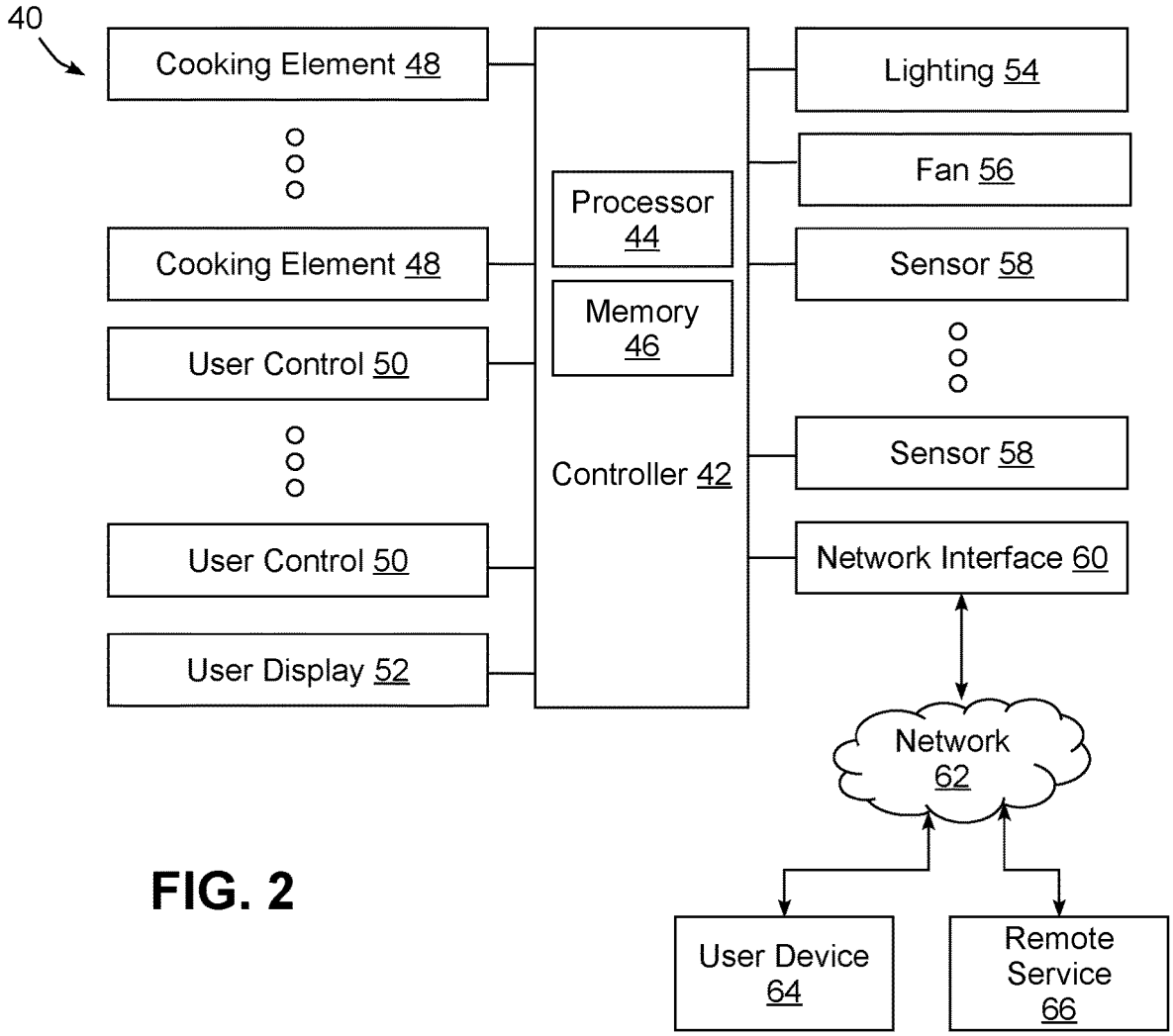
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity, including, for example, a temperature sensor for sensing temperature in a center of the oven cavity and/or one or more temperature sensors for sensing temperature in the top and/or bottom of the oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. Further, in some embodiments, cooking appliance 40 may be interfaced with one or more remote services 66, e.g., cloud-based services, remote servers.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Electronically-Controlled Gas Burner Verification

As noted above, electronically-controlled gas burners present a number of failure mechanisms that, if not properly diagnosed, could result in either an inability to ignite a gas burner, an inability to shut off a gas burner, or potentially an output of uncombusted gas from the gas burner. An electromechanical gas valve, for example, could stick in an open or closed position, or an igniter could fail to operate. In addition, miswirings could occur during manufacture or during service. In embodiments consistent with the invention, the potential for gas valve failures may be mitigated through the use of multiple gas valves in series between a gas burner and a gas supply, such that if one gas valve fails, the other gas valve can still shut off gas flow. Moreover, embodiments consistent with the invention additionally utilize gas burner verification to potentially identify when a failure has existed in a gas valve, and in some instances, which gas valve has exhibited problematic operation, so that a controller may alert a user or other entity of a potential need for service and/or disable further use of the gas burner until any problems have been resolved.

Figure 3:
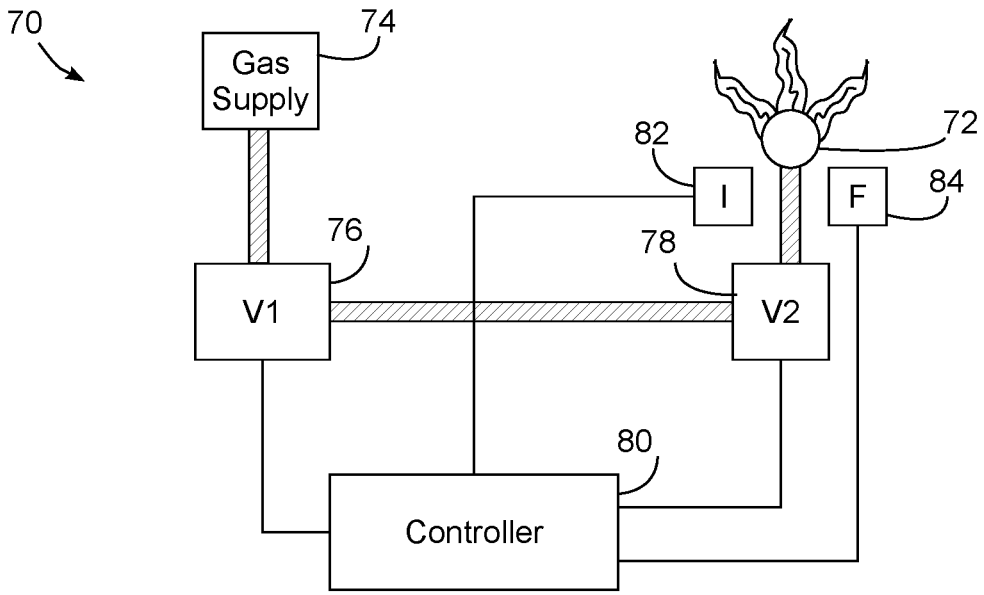
FIG. 3 is a block diagram of an example electronically-controlled gas burner system consistent with some embodiments of the invention.

FIG. 3, for example, illustrates an example electronic control system 70 for a gas burner 72 supplied with gas by a gas supply 74. Multiple electronically-controlled gas valves, e.g., gas valves 76, 78 (also denoted hereinafter as valves V1 and V2), are coupled in series between gas burner 72 and gas supply 74, and are electronically controlled by a controller 80. Ignition of gas burner 72 is provided by an igniter 82 that is positioned proximate to gas burner 72 and configured to ignite gas supplied to the gas burner, and an ignition sensor 84 is also positioned proximate to gas burner 72 to detect ignition of the gas burner. Controller 80 is coupled to each of igniter 82 and ignition sensor 84 such that through electronic control of gas valves 76, 78 and igniter 82, and through sensing of the ignition status with ignition sensor 84, controller 80 is able to both operate and monitor the status of gas burner 72.

Gas burner 72 in the illustrated embodiment may be used in a cooking appliance such as a cooktop gas burner or an oven gas burner, although in some embodiments, gas burner 72 may be utilized in other types of gas heating applications, e.g., water heaters, furnaces, ovens, grills, fireplaces, dryers, etc. Gas supply 74 may be internal to an apparatus within which gas burner 72 is disposed, or may be external, and may supply various types of gas such as liquid propane, natural gas, etc.

Each gas valve 76, 78 is electronically-controllable, and may be either an on/off-type valve, e.g., controlled via a solenoid, that has a fixed flow rate, or may be a variable valve, e.g., controlled via current or a stepper motor, and thus capable of additionally varying the flow rate of gas through the gas valve. Moreover, while two gas valves are illustrated in series, additional valves may also be in fluid communication with gas valves 76, 78 and gas burner 72 in other embodiments, and the additional valves may be electronically-controllable or manually-controllable in various embodiments (e.g., a manually-controlled variable valve could be used to control flow rate separately from gas valves 76, 78). Furthermore, it will be appreciated that controller 80 may control multiple gas burners in other embodiments, and as such, one or both of gas valves 76, 78 may be shared by multiple gas burners in some embodiments, rather than dedicated to a particular gas burner. As an example, FIG. 7, discussed in greater detail below, illustrates a series connection of a shared gas valve and multiple dedicated gas valves to control multiple gas burners.

Igniter 82 may be a direct igniter such as a spark igniter in some embodiments, while in other embodiments, a proven igniter such as a hot surface igniter may be used, whereby each igniter remains active the entire time gas is flowing. In other embodiments, e.g., where a standing pilot is used, igniter 82 may be omitted. Ignition sensor 84 may be implemented using a flame detector or other suitable technology for detecting when gas burner 72 is ignited and generating heat. In addition, it will be appreciated that in some embodiments, an igniter and an ignition sensor may be integrated into the same component that performs both functions.

Controller 80 may generally control gas burner 72 through ignition and shut off operations. In an ignition operation, each of gas valves 76, 78 is actuated to supply gas to gas burner 72 and igniter 82 (if used) is actuated to ignite the gas supplied to the gas burner, with ignition sensor 84 used to detect when the gas burner has ignited. Where direct ignition is used, igniter 82 may also be deactivated once successful ignition is detected. In a shut off operation, each of gas valves 76, 78 is deactivated to shut off the supply of gas to the gas burner, thereby extinguishing the gas burner.

In the illustrated embodiments, controller 80 additionally implements gas burner functional verification to verify the functional operation of the gas burner, and if necessary to generate an alert and/or disable the gas burner in response to a functional verification failure. As will become more apparent below, the functional verification may be performed during shut off operations, and in some embodiments, during ignition operations as well, to verify that each of gas valves 76, 78 has both opened and closed when so commanded by the controller. Further, where the gas burner is used in a cooking appliance, the functional verification may be performed during one or more cooking operations, e.g., cooking food in an oven or on a cooktop. The functional verification may be based at least in part on sequencing the activation and/or deactivation of gas valves 76, 78 such that, during at least a portion of the operation, the ignition state of the gas burner is tested while one of the gas valves is activated and the other is deactivated to confirm that the gas burner is or is not ignited.

In some embodiments, the ignition and/or shut off operations may be performed specifically in response to user input, e.g., for a cooktop gas burner, user input directed towards turning on and shutting off the gas burner. In other embodiments, however, the ignition and/or shut off operations may be performed in association with performing a heating operation with a gas burner, e.g., cycling a gas burner during a cooking operation in a gas oven, cycling a gas burner when heating with a furnace or hot water heater, etc.

For the purposes of the explanation hereinafter, gas valves 76, 78 are referred to as valves V1 and V2, and while gas valve 76/V1 is illustrated in FIG. 3 as being upstream of gas valve 78/V2, it will be appreciated that for the purposes of functional verification as described herein, the upstream/downstream relationship between gas valves 76/V1 and 78/V2 is not relevant, and thus may be reversed in other embodiments.

Figure 4:
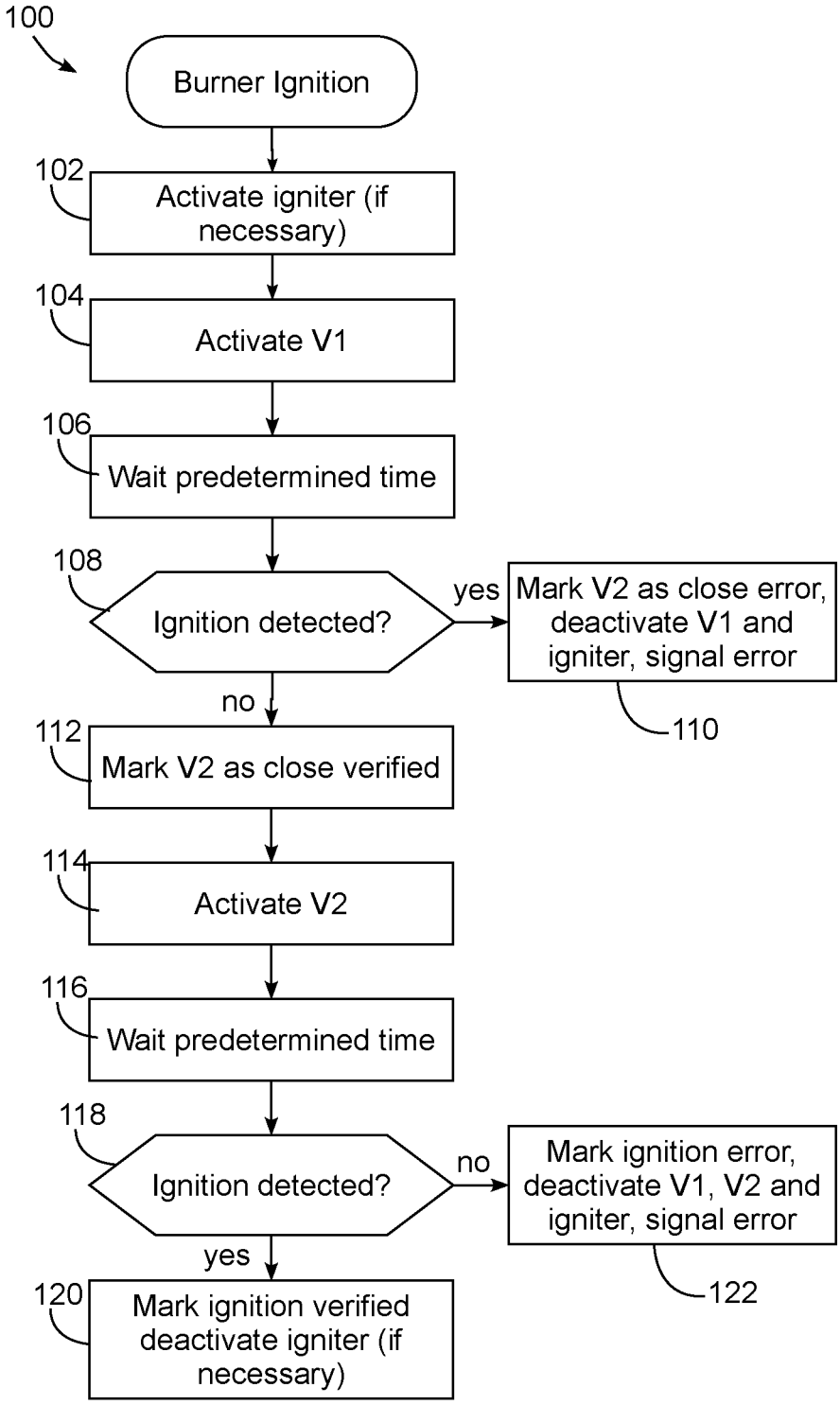
FIG. 4 is a flowchart illustrating an example sequence of operations for igniting a gas burner with the electronically-controlled gas burner system of FIG. 3.
Figure 5:
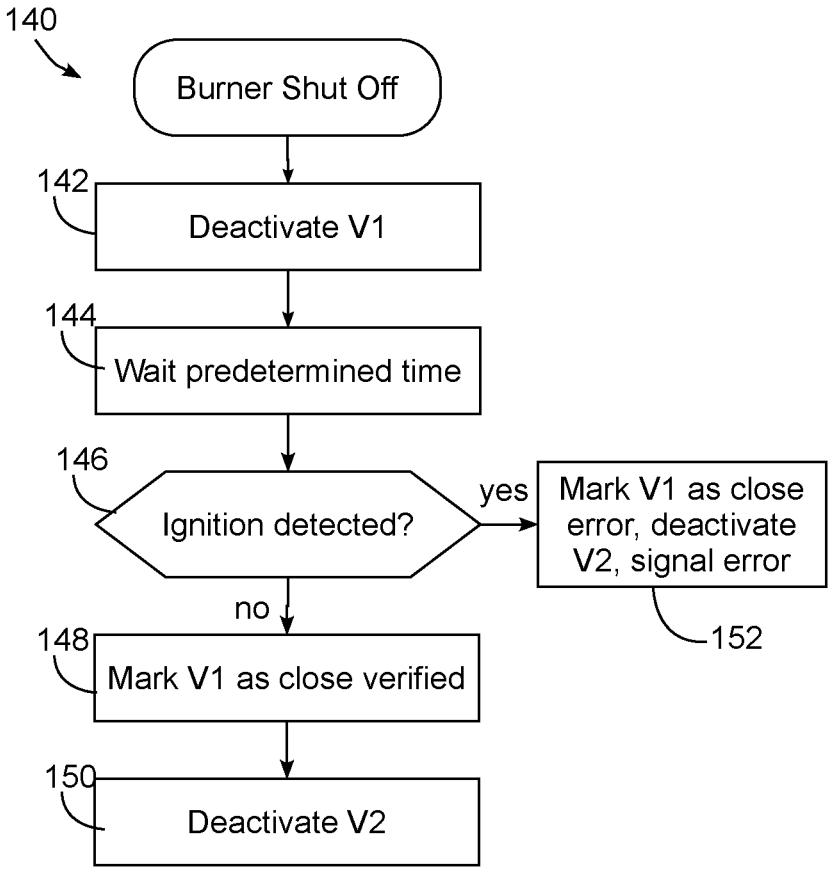
FIG. 5 is a flowchart illustrating an example sequence of operations for shutting off a gas burner with the electronically-controlled gas burner system of FIG. 3.

In one embodiment, illustrated more specifically in FIGS. 4-5, aspects of functional verification are performed during both the ignition and shut off operations performed for the gas burner. FIG. 4, for example, illustrates an example sequence of operations 100 for performing an ignition operation for gas burner 72 with controller 80. It is assumed that at this time, both valves V1 and V2 are closed.

First, in block 102, if necessary for ignition, igniter 82 is activated. Next, controller 80 activates gas valve V1 (block 104) and waits a predetermined period of time (block 106) before monitoring for burner ignition with ignition sensor 84 to confirm that the gas burner is not ignited in block 108. If ignition is detected at this time, a potential fault exists since gas valve V2 is expected to be closed. As such, control passes to block 110 to mark gas valve V2 as having a valve close error, i.e., that the gas valve is believed as being unable to close properly. At this time, gas valve V1 and igniter 82 may be deactivated to effectively disable gas burner 72. In addition to or in lieu of deactivating these components, an error may also be signaled, e.g., by generating a user notification such as an audible alert, a message on a display, a message on a mobile device, a message to a service organization, etc. In addition, in some embodiments the user notification may include an identification of the affected gas burner as well as the type of error encountered, e.g., a valve close error for valve V2 as described above.

Returning to block 108, if ignition is not detected, a confirmation of no ignition has been made and control passes to block 112 to mark gas valve V2 as close verified, indicating that the gas valve has been verified as being in its expected closed state.

Next, in block 114, gas valve V2 may be activated, and in block 116 controller 80 waits a predetermined time before monitoring for burner ignition with ignition sensor 84 in block 118 to confirm that the gas burner is ignited. If ignition is detected, control passes to block 120 to mark the gas burner as being ignition verified, which indicates that both gas valves V1 and V2 have opened correctly, the igniter has functioned correctly, and the entire system has worked correctly to ensure proper burner ignition. In addition, if direct ignition is used, igniter 82 may be deactivated at this time.

Returning to block 118, if no ignition is detected, control passes to block 122, and controller 80 marks the gas burner as having an ignition error, which may indicate that one of gas valves V1, V2, the igniter, the ignition sensor, or some combination of these components is not working properly. At this time, gas valves V1 and V2 and igniter 82 may be deactivated to effectively disable gas burner 72. In addition to or in lieu of deactivating these components, an error may also be signaled, e.g., by generating a user notification such as an audible alert, a message on a display, a message on a mobile device, a message to a service organization, etc. In addition, in some embodiments the user notification may include an identification of the affected gas burner as well as the type of error encountered, e.g., an ignition error as described above.

In some embodiments, sequence 100 may alternate the order in which gas valves V1 and V2 are activated in blocks 104 and 114, e.g., such that each gas valve V1, V2 is activated first in every other ignition operation. Doing so may enable the ability of both gas valves to close properly to be verified after two ignition operations.

Now turning to FIG. 5, this figure illustrates an example sequence of operations 140 for performing a shut off operation for gas burner 72 with controller 80. It is assumed that at this time, both valves V1 and V2 are open and gas burner 72 is ignited. First, in block 142, controller 80 deactivates gas valve V1 and then in block 144, the controller waits a predetermined time before monitoring for burner ignition with ignition sensor 84 in block 146 to confirm that the gas burner is not ignited. If no ignition is detected, the gas burner has been extinguished, and control passes to block 148 to mark gas valve V1 as close verified. Gas valve V2 may then be deactivated in block 150, and the shut off operation is complete.

Returning to block 146, if ignition is still detected after gas valve V1 has been deactivated, control passes to block 152 to mark gas valve V1 as having a valve close error, i.e., that the gas valve is believed as being unable to close properly. At this time, gas valve V2 may be deactivated to effectively disable gas burner 72. In addition to or in lieu of deactivating gas valve V2, an error may also be signaled, e.g., by generating a user notification such as an audible alert, a message on a display, a message on a mobile device, a message to a service organization, etc. In addition, in some embodiments the user notification may include an identification of the affected gas burner as well as the type of error encountered, e.g., a valve close error for valve V1 as described above.

It will be appreciated that through the use of sequence 100 during ignition operations and sequence 140 during shut off operations, both gas valve V1 and gas valve V2 are functionally verified to both open and close properly each burner ignition/shut off cycle. Gas valve V1, in particular, is verified to open correctly in block 118 once ignition is detected after both gas valves V1 and V2 are activated and verified to close correctly in block 146 once ignition is no longer detected after gas valve V1 is deactivated. Gas valve V2, in turn, is verified to open correctly in block 118 once ignition is detected after both gas valves V1 and V2 are activated and verified to close correctly in block 108 when ignition is not detected after gas valve V1 has been activated. In this manner, controller 80 may be certain that both gas valves V1 and V2 are operating properly at all times and thereby mitigate the risk of relying on a single gas valve after one gas valve has ceased operating properly.

Figure 6:
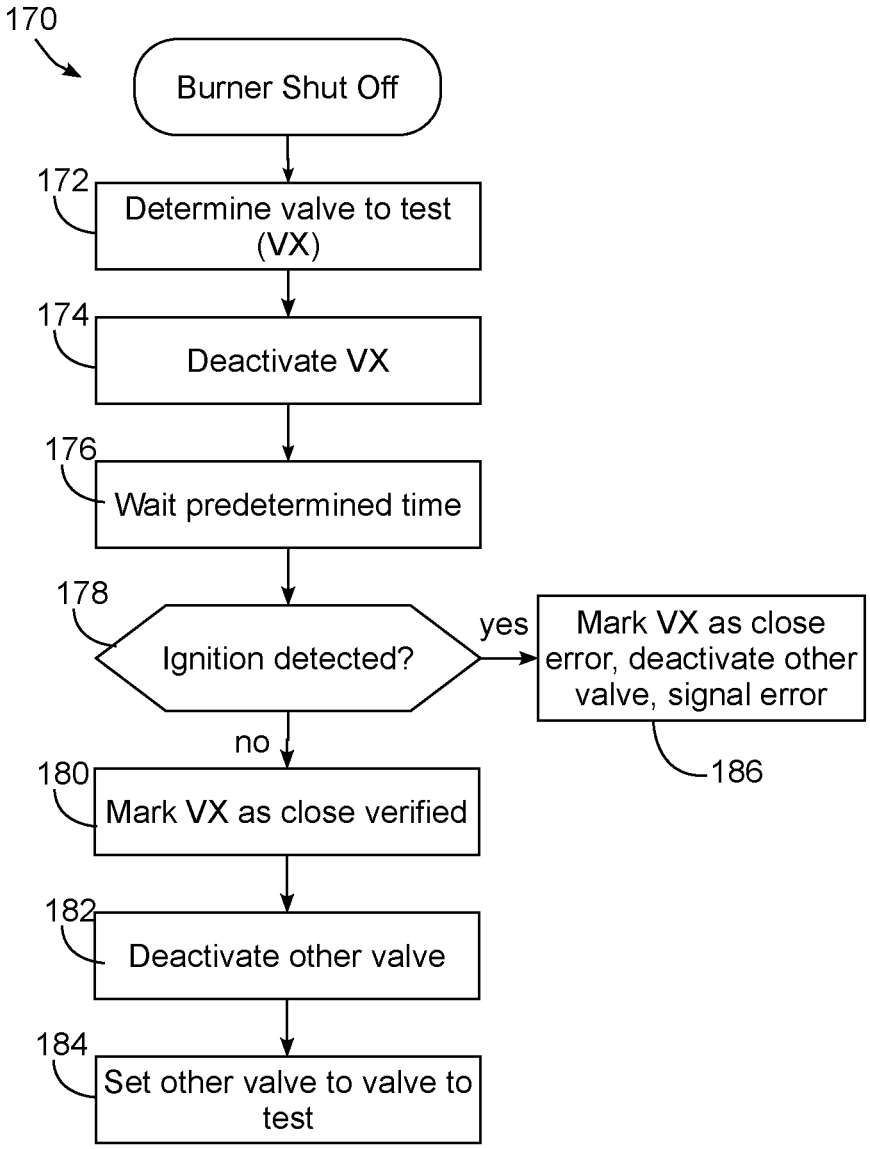
FIG. 6 is a flowchart illustrating another example sequence of operations for shutting off a gas burner with the electronically-controlled gas burner system of FIG. 3.

Now turning to FIG. 6, in some embodiments functional verification may be performed only during shut off operations, e.g., in applications where it may be undesirable to delay ignition of the gas burner. In these embodiments, the order in which the gas valves are deactivated during shut off is alternated for each gas burner ignition/shut off cycle, such that both gas valves may be functionally verified to close properly after two such cycles. It will be appreciated that in other embodiments, the sequencing in which the order is alternated may vary, e.g., where it may be desirable to test one gas valve more frequently than the other. It will also be appreciated that, should the gas burner fail to ignite during an ignition operation, it may be assumed that some issue exists with the gas burner without sequencing the gas valves as discussed above in connection with FIG. 4 (be it an inability to open one of gas valves V1, V2 or an inability to activate igniter 82 or to sense ignition with ignition sensor 84), so functional verification that each valve closes properly may be sufficient functional verification for some applications.

FIG. 6, in particular, illustrates an example sequence of operations 170 for performing a shut off operation for gas burner 72 with controller 80. It is assumed that at this time, both gas valves V1 and V2 are open and gas burner 72 is ignited. Moreover, it is assumed that a variable VX is set to one of the gas valves V1 or V2, and represents the current gas valve being tested during this shut off operation. Thus, sequence 170 begins in block 172 by determining the gas valve to test during this shut off operation, and block 174 deactivates gas valve VX. Next, in block 176, the controller waits a predetermined time before monitoring for burner ignition with ignition sensor 84 in block 178 to confirm that the gas burner is not ignited. If no ignition is detected, the gas burner has been extinguished, and control passes to block 180 to mark gas valve VX as close verified. The other gas valve (gas valve V2 if VX=V1, or gas valve V1 if VX=V2) may then be deactivated in block 182, and in block 184, the other gas valve is selected as the gas valve to test (VX), such that the next time that gas burner 72 is shut off, the other gas valve will be tested. The shut off operation is then complete.

Returning to block 178, if ignition is still detected after gas valve VX has been deactivated, control passes to block 186 to mark gas valve VX as having a valve close error, i.e., that the gas valve is believed as being unable to close properly. At this time, the other gas valve may be deactivated to effectively disable gas burner 72. In addition to or in lieu of deactivating the other gas valve, an error may also be signaled, e.g., by generating a user notification such as an audible alert, a message on a display, a message on a mobile device, a message to a service organization, etc. In addition, in some embodiments the user notification may include an identification of the affected gas burner as well as the type of error encountered, e.g., a valve close error for valve VX as described above.

It will be appreciated that the predetermined times discussed above in connection with blocks 106 and 116 of FIG. 4, block 144 of FIG. 5 and block 176 of FIG. 6 may vary from one another in different embodiments, and may be selected to be of sufficient duration for verifying either ignition of or extinguishment of gas burner 72. The predetermined times may be determined empirically in some embodiments, and may vary based upon factors such as burner design as well as the design of the various components utilized therewith.

Figure 7:
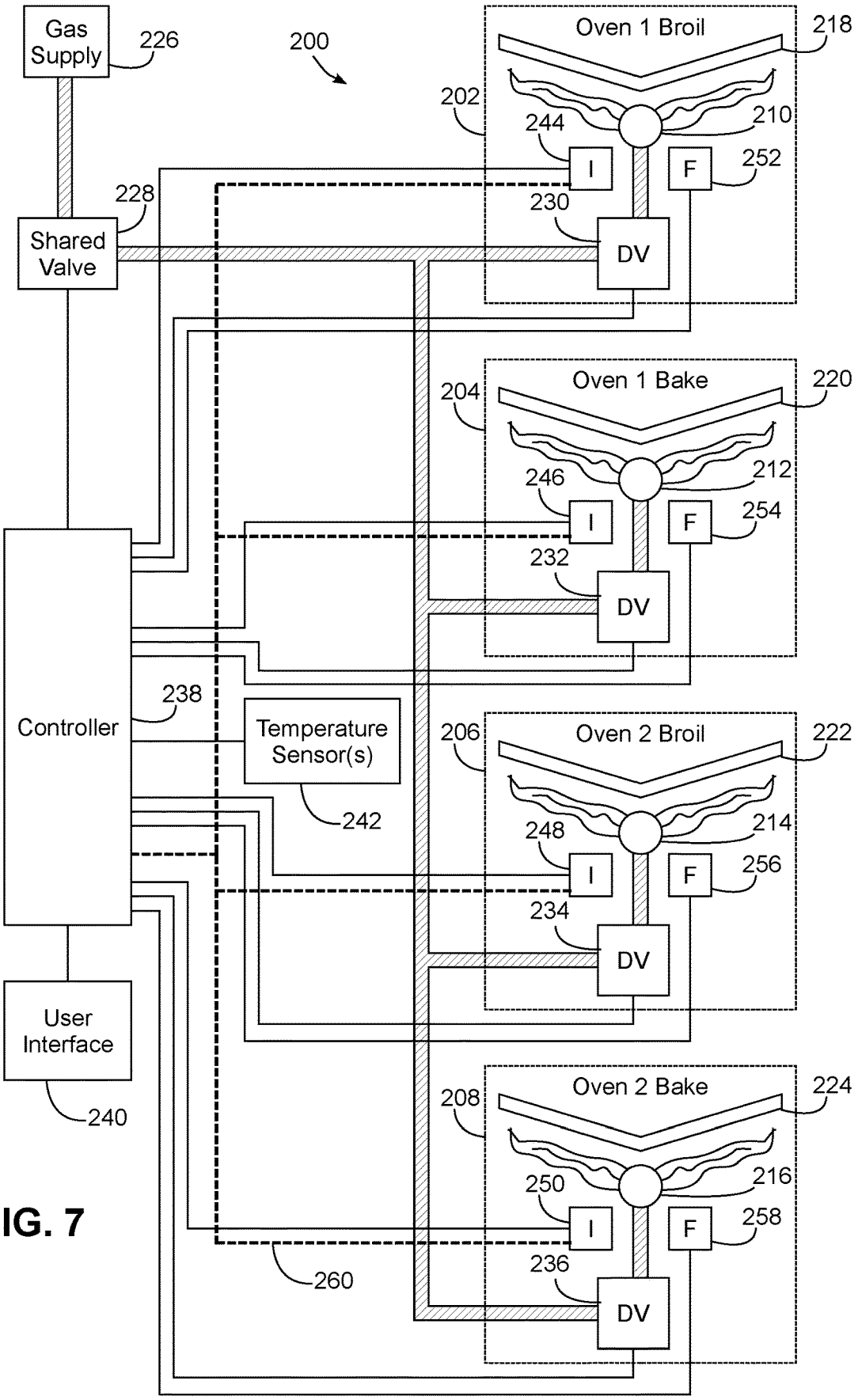
FIG. 7 is a block diagram of an example gas oven control system consistent with some embodiments of the invention.

As noted above, functional verification as described herein may be utilized in a number of different gas burner applications. FIG. 7, for example, illustrates an example cooking appliance 200, e.g., a range or wall oven. Cooking appliance 200 includes two oven cavities or ovens, each with bake and broil functionality, represented at 202 (oven 1 broil), 204 (oven 1 bake), 206 (oven 2 broil) and 208 (oven 2 bake). Each includes a respective gas burner 210, 212, 214, 216 and associated flame spreader 218, 220, 222, 224. Gas is supplied to the control system from a gas supply 226 that may be internal or external to the appliance, with a shared gas valve 228 outputting to a set of dedicated gas valves 230, 232, 234, 236 that are dedicated to each of gas burners 210, 212, 214, 216, such that when the shared gas valve 228 is activated along with one of the dedicated gas valves 230, 232, 234, 236, the respective gas burner 210, 212, 214, 216 is in fluid communication with gas supply 226. The gas lines representing the gas flow paths from gas supply 226 to gas burners 210, 212, 214, 216 are shown in cross-hatching.

A controller 238, e.g., a microprocessor, a microcontroller, a control circuit, etc. (including any supporting hardware circuitry), is electrically coupled to each gas valve 228-236 to selectively activate each gas valve 228-236. In the illustrated embodiment, each gas valve 228-236 is an on/off valve, such that each gas burner has a fixed output power or level. In other embodiments, any of gas valves 228-236 may be variable gas valves, or additional variable gas valves may be included in the gas flow paths, in order to regulate the output level of one or more of the gas burners.

Controller 238 may also be coupled to a user interface 240, e.g., a display, one or more indicators, a touch screen, a set of physical controls such as buttons, switches, knobs, etc., a remote device such as a mobile device, or any other suitable technology for receiving user input and/or displaying data to a user. Through user interface 240, for example, a user may select a cooking temperature or output level, a cycle type (e.g., bake, broil, convection bake, convection roast, etc.), a cycle time, a delay time, or any other settings that may be appropriate for a desired oven cooking cycle. In addition, one or more temperature sensors 242 may be disposed in each oven cavity to sense current temperature in the oven cavity.

Each gas burner 210, 212, 214, 216 also includes a respective igniter 244, 246, 248, 250 and a respective ignition sensor 252, 254, 256, 268. Each igniter 244, 246, 248, 250 may be a direct igniter such as a spark igniter in some embodiments, while in other embodiments, a proven igniter such as a hot surface igniter may be used, whereby each igniter remains active the entire time gas is flowing. Each ignition sensor 252, 254, 256, 258 may be implemented using a flame detector or another suitable technology for sensing ignition of a gas burner, or may be omitted in some embodiments. In addition, while controller 238 is illustrated as having separate control outputs routed to the individual igniters 244, 246, 248, 250 to support individual control thereof, in other embodiments, and as illustrated by dashed line 260, the igniters 244, 246, 248, 250 may be controlled by the same control output, e.g., generated by controller 238 or a separate ignition module.

Controller 238 may be similarly configured as controller 80, and may implement gas burner functional verification of each of gas burners 218, 220, 222 and 224. In this embodiment, shared valve 228 represents one of the two gas valves coupled in series to each gas burner 218, 220, 222 and 224, with the other gas valve being the respective dedicated gas valve 230, 232, 234, 236 associated with each gas burner 218, 220, 222 and 224. Furthermore, it will be appreciated that in some embodiments functional verification of a shared gas valve such as valve 228 may be spread across multiple ignition and/or shut off operations performed with different gas burners that share the shared valve.

Other modifications may be made to the embodiments discussed herein, and a number of the concepts disclosed herein may be used in combination with one another or may be used separately. Therefore, the invention lies in the claims hereinafter appended.

What is claimed is:

1. A cooking appliance, comprising:

a gas burner configured to generate heat for cooking;

an ignition sensor positioned proximate to the gas burner and configured to detect ignition of the gas burner;

first and second gas valves coupled in series to the gas burner to supply gas from a gas supply to the gas burner, wherein each of the first and second gas valves is electronically-controllable; and a controller coupled to the ignition sensor and the first and second gas valves, the controller configured to functionally verify the gas burner over one or more cooking operations by:

during ignition of the gas burner, activating the first gas valve prior to activating the second gas valve and confirming with the ignition sensor that the gas burner is not ignited while the first gas valve is activated and the second gas valve is deactivated;

after confirming with the ignition sensor that the gas burner is not ignited while the first gas valve is activated and the second gas valve is deactivated, activating the second gas valve and confirming with the ignition sensor that the gas burner is ignited while the first and second gas valves are activated; and during shut off of the gas burner, deactivating the first gas valve prior to deactivating the second gas valve and confirming with the ignition sensor that the gas burner is not ignited while the first gas valve is deactivated and the second gas valve is activated.

2. The cooking appliance of claim 1, wherein the controller is further configured to detect a valve close error for the second gas valve in response to detecting that the gas burner is ignited while the first gas valve is activated and the second gas valve is deactivated during ignition of the gas burner.

3. The cooking appliance of claim 1, wherein the controller is further configured to detect a valve close error for the first gas valve in response to detecting that the gas burner is ignited while the first gas valve is deactivated and the second gas valve is activated during shut off of the gas burner.

4. The cooking appliance of claim 1, wherein the controller is further configured to detect an ignition error in response to failing to detect that the gas burner is ignited while the first and second gas valves are activated during ignition of the gas burner.

5. The cooking appliance of claim 1, wherein the controller is further configured to generate an error notification for the gas burner in response to detecting at least one of:

the gas burner is ignited while the first gas valve is activated and the second gas valve is deactivated during ignition of the gas burner;

the gas burner is ignited while the first gas valve is deactivated and the second gas valve is activated during shut off of the gas burner; and the gas burner is ignited while the first and second gas valves are activated during ignition of the gas burner.

6. The cooking appliance of claim 1, wherein the controller is further configured to deactivate each of the first and second gas valves in response to detecting at least one of:

the gas burner is ignited while the first gas valve is activated and the second gas valve is deactivated during ignition of the gas burner;

the gas burner is ignited while the first gas valve is deactivated and the second gas valve is activated during shut off of the gas burner; and the gas burner is ignited while the first and second gas valves are activated during ignition of the gas burner.

7. The cooking appliance of claim 1, wherein the ignition sensor is a flame detector.

8. The cooking appliance of claim 1, further comprising an igniter positioned proximate to the gas burner and configured to ignite gas supplied to the gas burner, wherein the control is configured to activate the igniter during ignition of the gas burner.

9. The cooking appliance of claim 1, wherein the controller is configured to:

wait a first predetermined time between activating the first gas valve and confirming with the ignition sensor that the gas burner is not ignited while the first gas valve is activated and the second gas valve is deactivated;

wait a second predetermined time between activating the second gas valve and confirming with the ignition sensor that the gas burner is ignited while the first and second gas valves are activated; and wait a third predetermined time between deactivating the first gas valve and confirming with the ignition sensor that the gas burner is not ignited while the first gas valve is deactivated and the second gas valve is activated.

10. The cooking appliance of claim 1, further comprising an oven cavity, wherein the gas burner is an oven gas burner configured to generate heat within the oven cavity.

11. The cooking appliance of claim 1, further comprising a cooktop, wherein the gas burner is a cooktop gas burner.

12. The cooking appliance of claim 1, wherein each of the first and second gas valves are dedicated to the gas burner.

13. The cooking appliance of claim 1, wherein the gas burner is a first gas burner and the ignition sensor is a first ignition sensor, wherein the cooking appliance further comprises a second gas burner configured to generate heat for cooking, a second ignition sensor positioned proximate to the second gas burner and configured to detect ignition of the second gas burner, and a third gas valve coupled in series with one of the first and second gas valves to supply gas from the gas supply to the second gas burner, wherein the one of the first and second gas valves is shared by the first and second gas burners.

14. The cooking appliance of claim 1, wherein the first gas valve is upstream of the second gas valve.

15. The cooking appliance of claim 1, wherein the first gas valve is downstream of the second gas valve.

16. The cooking appliance of claim 1, wherein the controller is configured to deactivate the first gas valve prior to deactivating the second gas valve and confirm with the ignition sensor that the gas burner is not ignited while the first gas valve is deactivated and the second gas valve is activated during a first shut off of the gas burner, wherein the controller is further configured to, during a second shut off of the gas burner, deactivate the second gas valve prior to deactivating the first gas valve and confirm with the ignition sensor that the gas burner is not ignited while the first gas valve is activated and the second gas valve is deactivated.

17. The cooking appliance of claim 1, wherein at least one of ignition of the gas burner and shut off of the gas burner is performed in response to user input associated with the one or more cooking operations.

18. A cooking appliance, comprising:

a gas burner configured to generate heat for cooking;

an ignition sensor positioned proximate to the gas burner and configured to detect ignition of the gas burner;

first and second gas valves coupled in series to the gas burner to supply gas from a gas supply to the gas burner, wherein each of the first and second gas valves is electronically-controllable; and a controller coupled to the ignition sensor and the first and second gas valves, the controller configured to functionally verify the gas burner over one or more cooking operations by:

during a first shut off of the gas burner performed when the first and second gas valves are activated and the gas burner is ignited, deactivating the first gas valve prior to deactivating the second gas valve and confirming with the ignition sensor that the gas burner is not ignited while the first gas valve is deactivated and the second gas valve is activated; and during a second shut off of the gas burner performed when the first and second gas valves are activated and the gas burner is ignited, deactivating the second gas valve prior to deactivating the first gas valve and confirming with the ignition sensor that the gas burner is not ignited while the first gas valve is activated and the second gas valve is deactivated.

19. The cooking appliance of claim 18, wherein the controller is further configured to generate an error notification for the gas burner in response to detecting at least one of:

the gas burner is ignited while the first gas valve is deactivated and the second gas valve is activated during the first shut off of the gas burner; and the gas burner is ignited while the first gas valve is activated and the second gas valve is deactivated during the second shut off of the gas burner.

20. The cooking appliance of claim 18, wherein the controller is further configured to deactivate each of the first and second gas valves in response to detecting at least one of:

the gas burner is ignited while the first gas valve is deactivated and the second gas valve is activated during the first shut off of the gas burner; and the gas burner is ignited while the first gas valve is activated and the second gas valve is deactivated during the second shut off of the gas burner.

21. An apparatus, comprising:

a gas burner configured to generate heat;

an ignition sensor positioned proximate to the gas burner and configured to detect ignition of the gas burner;

first and second gas valves coupled in series to the gas burner to supply gas from a gas supply to the gas burner, wherein each of the first and second gas valves is electronically-controllable; and a controller coupled to the ignition sensor and the first and second gas valves, the controller configured to functionally verify the gas burner by:

during ignition of the gas burner, activating the first gas valve prior to activating the second gas valve and confirming with the ignition sensor that the gas burner is not ignited while the first gas valve is activated and the second gas valve is deactivated;

after confirming with the ignition sensor that the gas burner is not ignited while the first gas valve is activated and the second gas valve is deactivated, activating the second gas valve and confirming with the ignition sensor that the gas burner is ignited while the first and second gas valves are activated; and during shut off of the gas burner, deactivating the first gas valve prior to deactivating the second gas valve and confirming with the ignition sensor that the gas burner is not ignited while the first gas valve is deactivated and the second gas valve is activated.

22. An apparatus, comprising:

a gas burner configured to generate heat;

an ignition sensor positioned proximate to the gas burner and configured to detect ignition of the gas burner;

first and second gas valves coupled in series to the gas burner to supply gas from a gas supply to the gas burner, wherein each of the first and second gas valves is electronically-controllable; and a controller coupled to the ignition sensor and the first and second gas valves, the controller configured to functionally verify the gas burner by:

during a first shut off of the gas burner performed when the first and second gas valves are activated and the gas burner is ignited, deactivating the first gas valve prior to deactivating the second gas valve and confirming with the ignition sensor that the gas burner is not ignited while the first gas valve is deactivated and the second gas valve is activated; and during a second shut off of the gas burner performed when the first and second gas valves are activated and the gas burner is ignited, deactivating the second gas valve prior to deactivating the first gas valve and confirming with the ignition sensor that the gas burner is not ignited while the first gas valve is activated and the second gas valve is deactivated.

* * * * *